US011403923B2

(12) United States Patent
Hsu et al.

(10) Patent No.: US 11,403,923 B2
(45) Date of Patent: Aug. 2, 2022

(54) SELECTIVELY ENABLED TAMPER DETECTION

(71) Applicant: Ademco Inc., Golden Valley, MN (US)

(72) Inventors: Wen Hua Hsu, Forest Hills, NY (US); Mark Schmidt, West Islip, NY (US)

(73) Assignee: Ademco Inc., Golden Valley, MN (US)

( * ) Notice: Subject to any disclaimer, the term of this patent is extended or adjusted under 35 U.S.C. 154(b) by 0 days.

(21) Appl. No.: 17/115,938

(22) Filed: Dec. 9, 2020

(65) Prior Publication Data

US 2022/0180717 A1 Jun. 9, 2022

(51) Int. Cl.
*G08B 13/06* (2006.01)
*G08B 29/04* (2006.01)

(52) U.S. Cl.
CPC ..... *G08B 13/06* (2013.01); *G08B 29/046* (2013.01)

(58) Field of Classification Search
CPC ..... G08B 13/06; G08B 29/046; G08B 29/08
See application file for complete search history.

(56) References Cited

U.S. PATENT DOCUMENTS 5,764,729 A * 6/1998 Black ..... G08B 29/08 340/566
6,089,626 A * 7/2000 Shoemaker ..... E05B 47/0002 292/201
6,377,174 B1 4/2002 Siegwart et al.
7,292,145 B2 * 11/2007 Castle ..... G08B 29/046 340/542
7,388,484 B2 * 6/2008 Hsu ..... G06F 21/83 340/506
9,761,098 B2 * 9/2017 Pai ..... G08B 13/08
2005/0247085 A1 * 11/2005 Porter ..... E05B 47/0603 70/210
2006/0197662 A1 * 9/2006 Castle ..... G08B 29/046 340/545.6
2007/0040674 A1 * 2/2007 Hsu ..... G08B 29/046 340/539.31
2007/0236349 A1 10/2007 Ho Lee
2008/0084292 A1 4/2008 Dipoala
2009/0167538 A1 7/2009 Merritt et al.
(Continued)

FOREIGN PATENT DOCUMENTS

CN 200962248 Y 10/2007
CN 201184122 Y 1/2009
(Continued)

OTHER PUBLICATIONS

Mark Kretschmar, Lion Precision Sensors, "Capacitive Sensor Operation Part 1: The Basics", May 1, 2009, 6 pgs.
(Continued)

*Primary Examiner* — Hoi C Lau
(74) *Attorney, Agent, or Firm* — Fredrikson & Byron, P.A.

(57) ABSTRACT

A device includes a housing, a tamper switch supported at the housing, and a tamper actuator receivable at the housing. The tamper actuator is movable between a tamper disabled position and a tamper enabled position. In the tamper disabled position, the tamper actuator is fixed in place at the housing. In the tamper enabled position, the tamper actuator is configured to move relative to the housing between a tamper switch engaged position and a tamper switch released position.

20 Claims, 10 Drawing Sheets

(56) References Cited

U.S. PATENT DOCUMENTS

| | | | | |
|---|---|---|---|---|
| 2009/0320537 | A1* | 12/2009 | Alexander | E05B 45/005 70/277 |
| 2010/0295665 | A1* | 11/2010 | Landau | G08B 21/0288 340/10.42 |
| 2010/0321186 | A1* | 12/2010 | Crook | G08B 25/10 340/568.6 |
| 2010/0328056 | A1 | 12/2010 | Merkel et al. | |
| 2012/0152883 | A1* | 6/2012 | Zhang | E05B 73/0041 215/201 |
| 2012/0161976 | A1 | 6/2012 | Xie et al. | |
| 2012/0188081 | A1 | 7/2012 | Van Katwijk | |
| 2012/0319842 | A1 | 12/2012 | Amis | |
| 2013/0113397 | A1 | 5/2013 | Salter et al. | |
| 2013/0240739 | A1 | 9/2013 | Shpater | |
| 2015/0339568 | A1 | 11/2015 | Nekoogar et al. | |
| 2016/0196729 | A1* | 7/2016 | Pai | G08B 13/08 340/545.2 |
| 2017/0365142 | A1* | 12/2017 | Pai | H01H 13/183 |

FOREIGN PATENT DOCUMENTS

| | | | |
|---|---|---|---|
| CN | 202406227 | U | 8/2012 |
| CN | 202794529 | U | 3/2013 |
| CN | 203733183 | U | 7/2014 |
| CN | 204406587 | U | 6/2015 |
| CN | 205987103 | U | 2/2017 |
| CN | 207010795 | U | 2/2018 |
| CN | 207337580 | U | 5/2018 |
| CN | 207354462 | U | 5/2018 |
| CN | 208638499 | U | 3/2019 |

OTHER PUBLICATIONS

Mark Kretschmar, Lion Precision Sensors, "Capacitive Sensor Operation Part 2: System Optimization", Jun. 1, 2009, 5 pgs.

Thomas Perme et al., "Capacitive Touch Using Only an ADC ("CVD") AN1298", Microchip Technology Inc., DS01298A, Mar. 26, 2009, 4 pgs.

Atmel, "Proximity Design Guide, Application Note QTAN0087", 10760A-AT42, Nov. 2011, 12 pgs.

Atmel, "QTouch 12-channel Touch Sensor IC, AT42QT2120 [Preliminary]", 9634AX-AT42, Nov. 2011, 42 pgs.

Atmel Delivers QTouch Capacitive Touch Controller, downloaded from http://sensorsmag.com/electronics-computers/news/atmel-delivers-qtouch-capacitive-touch-control . . . on Nov. 16, 2011, 2 pgs.

Cypress Semiconductor Corporation, "Cypress Perform, PSoC Programmable System-on-Chip", Document No. 001-67345, Rev *A, Revised May 13, 2011, 47 pgs.

Cypress Semiconductor, "Cypress Perform, CY3235-ProxDet, CapSense Proximity Detection Demonstration Kit Guide", Doc. #: 001-67986 Rev. *B, Oct. 14, 2011, 34 pgs.

NXP Semiconductors, "PCA8886—Dual channel capacitive proximity switch with auto-calibration and large voltage operating range", Rev. 1—Nov. 23, 2011, 26 pgs.

Semtech Launches Smart Proximity Sensor, downloaded from http://sensorsmag.com/electronice-computers/consumer/news/semtech-launches-smart-proximity-sensor-10190?print=1, dated Jun. 25, 2012, 3 pgs.

* cited by examiner

SELECTIVELY ENABLED TAMPER DETECTION

TECHNICAL FIELD

This disclosure relates generally to selectively enabled tamper detection mechanisms, for instance, that can be included in various devices, systems, and methods. In some embodiments, when enabled, such tamper detection mechanisms can detect when an associated device is removed from a mounting surface.

BACKGROUND

Security devices can be used to monitor one or more conditions at a premise and, when a predetermined event occurs, alert to the occurrence of that event. An intruder at the premise may attempt to defeat a security function of a security device by attempting to remove the security device from its mounting surface. The intent of the intruder in attempting to remove the security device could be to terminate a power supply and/or a communication link at the security device and, thereby, render the security function of that device ineffective.

SUMMARY

To enhance the security of a device (e.g., a security device), it can be useful to detect an attempt to tamper with the security device. This disclosure in general describes selectively enabled tamper detection mechanism embodiments that can be included in various devices and systems as well as in related methods. In particular, embodiments disclosed herein can, when enabled, facilitate a tamper detection functionality, such as detecting removal of a housing from a mounting surface, in an improved manner.

For example, tamper detection mechanism embodiments disclosed herein can facilitate tamper detection functionality at a housing that is mounted to a mounting surface in a variety of manners. Prior tamper mechanisms may generally require that the housing be screwed into the mounting surface in order to facilitate the tamper detection functionality. In particular, for such prior tamper mechanisms, this screwed mounting configuration is necessary to generate the force needed to shear the tamper mechanism upon removal of the housing from the mounting surface. Tamper detection mechanism embodiments disclosed herein, on the other hand, can facilitate the tamper detection functionality at the housing without requiring the housing to be screwed to the mounting surface. For example, tamper detection mechanism embodiments disclosed herein can provide the tamper detection functionality when, for instance, the housing is adhered to the mounting surface in a less robust manner. This can include tamper detection mechanism embodiments disclosed herein facilitating tamper detection functionality when, for instance, the housing is adhered to the mounting surface using adhesive foam tape or other less intrusive mounting mechanism(s) at the housing. In this way, tamper detection mechanism embodiments disclosed herein can reduce the structural impact associated with mounting the housing at a mounting surface and, thereby, increase the types of mounting surfaces at which the housing can be mounted.

As another example, tamper detection mechanism embodiments disclosed herein can provide an ability to selectively enable the tamper detection functionality. Prior tamper mechanisms typically include an always-on tamper detection functionality. However, this can be problematic in instances where the tamper detection functionality is not wanted. For instance, prior to installing the housing (e.g., when transporting the housing), the tamper detection functionality may not be needed. Moreover, some users may not desire a tamper detection functionality. Accordingly, tamper detection mechanism embodiments disclosed herein can provide an ability to selectively enable and disable the tamper detection functionality as desired for a particular application. This, in turn, can provide an improved tamper detection mechanism that can be utilized in a variety of applications.

One embodiment includes a device. This device embodiment includes a housing, a tamper switch supported at the housing, and a tamper actuator receivable at the housing. The tamper actuator is movable between a tamper disabled position and a tamper enabled position. In the tamper disabled position, the tamper actuator is fixed in place at the housing. In the tamper enabled position, the tamper actuator is configured to move relative to the housing between a tamper switch engaged position and a tamper switch released position.

In a further embodiment of the device, in the tamper switch engaged position, the tamper actuator contacts the tamper switch. And, in the tamper switch released position, the tamper actuator is spaced apart from the tamper switch.

In a further embodiment of the device, the tamper actuator is configured to move in a first direction between the tamper disabled position and the tamper enabled position. And, the tamper actuator is configured to move in a second direction between the tamper switch engaged position and the tamper switch released position. The second direction is different than the first direction. For example, the first direction can include a rotational direction about a longitudinal axis of the tamper actuator, and the second direction can include translational direction along the longitudinal axis of the tamper actuator.

In a further embodiment of the device, in the tamper disabled position, the tamper actuator is fixed in place at the housing so as to prohibit movement of the tamper actuator relative to the tamper switch.

In a further embodiment of the device, the housing includes a first locking feature and the tamper actuator includes a second locking feature that is complementary to the first locking feature. When the tamper actuator is in the tamper disabled position, the second locking feature engages the first locking feature to fix the tamper actuator in place at the housing. For instance, the second locking feature can engage the first locking feature when the tamper actuator is at a first rotational position relative to the housing, and the second locking feature can disengage from the first locking feature when the tamper actuator is at a second rotational position relative to the housing. The second rotational position is different than the first rotational position. As one example, the first locking feature can include a locking tab defined at the housing, and the second locking feature can include a flange extending outward from a body of the tamper actuator. The second locking feature can engage the first locking feature via an interference fit between the locking tab and the flange to fix the tamper actuator in place at the housing.

In a further embodiment of the device, when the tamper actuator is in the tamper enabled position, the device is configured to actuate the tamper switch upon either of the housing being removed from a mounting surface at which the housing is mounted or a portion of the housing being opened.

In a further embodiment of the device, the housing defines a guide sleeve, and the tamper actuator is receivable at the guide sleeve. When the tamper actuator is in the tamper enabled position, the tamper actuator is configured to move within the guide sleeve relative to the housing between the tamper switch engaged position and the tamper switch released position. As one example, the guide sleeve includes a first retention feature, and the tamper actuator includes a second retention feature that is complementary to the first retention feature. In this example, when the tamper actuator is in the tamper enabled position, the second retention feature engages the first retention feature to maintain the tamper actuator within the guide sleeve.

In a further embodiment of the device, the housing includes a tamper disabled indicator at a first location on the housing and a tamper enabled indicator at a second location on the housing. The second location is spaced apart along the housing from the first location. For example, the tamper disabled indicator corresponds to a first rotational position of the tamper actuator in the tamper disabled position, and the tamper enabled indicator corresponds to a second rotational position of the tamper actuator in the tamper enabled position. The first rotational position is rotationally offset from the second rotational position about a longitudinal axis of the tamper actuator. In this example, the tamper actuator can include a positional indicator, and this positional indicator can be aligned with the tamper disabled indicator when the tamper actuator is at the first rotational position, and the positional indicator can be aligned with the tamper enabled indicator when the tamper actuator is at the second rotational position.

Another embodiment includes a method. This method embodiment includes the step of moving a tamper actuator in a first direction, relative to a housing that includes a tamper switch, between a tamper disabled position and a tamper enabled position. In the tamper disabled position, the tamper actuator is fixed in place at the housing. In the tamper enabled position, the tamper actuator is configured to move in a second direction, relative to the housing, between a tamper switch engaged position and a tamper switch released position. The second direction is different than the first direction. This method embodiment also includes the step of mounting the housing at a mounting surface.

In a further embodiment of this method, the first direction can include a rotational direction about a longitudinal axis of the tamper actuator, and the second direction can include a translational direction along the longitudinal axis of the tamper actuator. For example, the housing can include a first locking feature and the tamper actuator can include a second locking feature that is complementary to the first locking feature. In this example, moving the tamper actuator in the first direction to the tamper disabled position can include engaging the second locking feature with the first locking feature to fix the tamper actuator in place at the housing. Also in this example, the second locking feature can engage the first locking feature when the tamper actuator is at a first rotational position relative to the housing, and the second locking feature can disengage from the first locking feature when the tamper actuator is at a second rotational position relative to the housing. The second rotational position is different than the first rotational position.

In a further embodiment of this method, when the tamper actuator is in the tamper enabled position, the tamper switch is actuatable by either removing the housing from a mounting surface at which the housing is mounted or opening a portion of the housing.

In a further embodiment of this method, the housing defines a guide sleeve, and the tamper actuator is received at the guide sleeve. When the tamper actuator is in the tamper enabled position, the tamper actuator is configured to move in the second direction, within the guide sleeve relative to the housing, between the tamper switch engaged position and the tamper switch released position.

The details of one or more examples are set forth in the accompanying drawings and the description below. Other features, objects, and advantages will be apparent from the description and drawings, and from the claims.

BRIEF DESCRIPTION OF DRAWINGS

The following drawings are illustrative of particular examples of the present invention and therefore do not limit the scope of the invention. The drawings are not necessarily to scale, though embodiments can include the scale illustrated, and are intended for use in conjunction with the explanations in the following detailed description wherein like reference characters denote like elements. Examples of the present invention will hereinafter be described in conjunction with the appended drawings.

In FIG. 2, an embodiment of a tamper actuator, of the tamper detection mechanism, is at an exemplary tamper switch engaged position.

DETAILED DESCRIPTION

The following detailed description is exemplary in nature and is not intended to limit the scope, applicability, or configuration of the invention in any way. Rather, the following description provides some practical illustrations for implementing examples of the present invention. Those skilled in the art will recognize that many of the noted examples have a variety of suitable alternatives.

Figure 1:
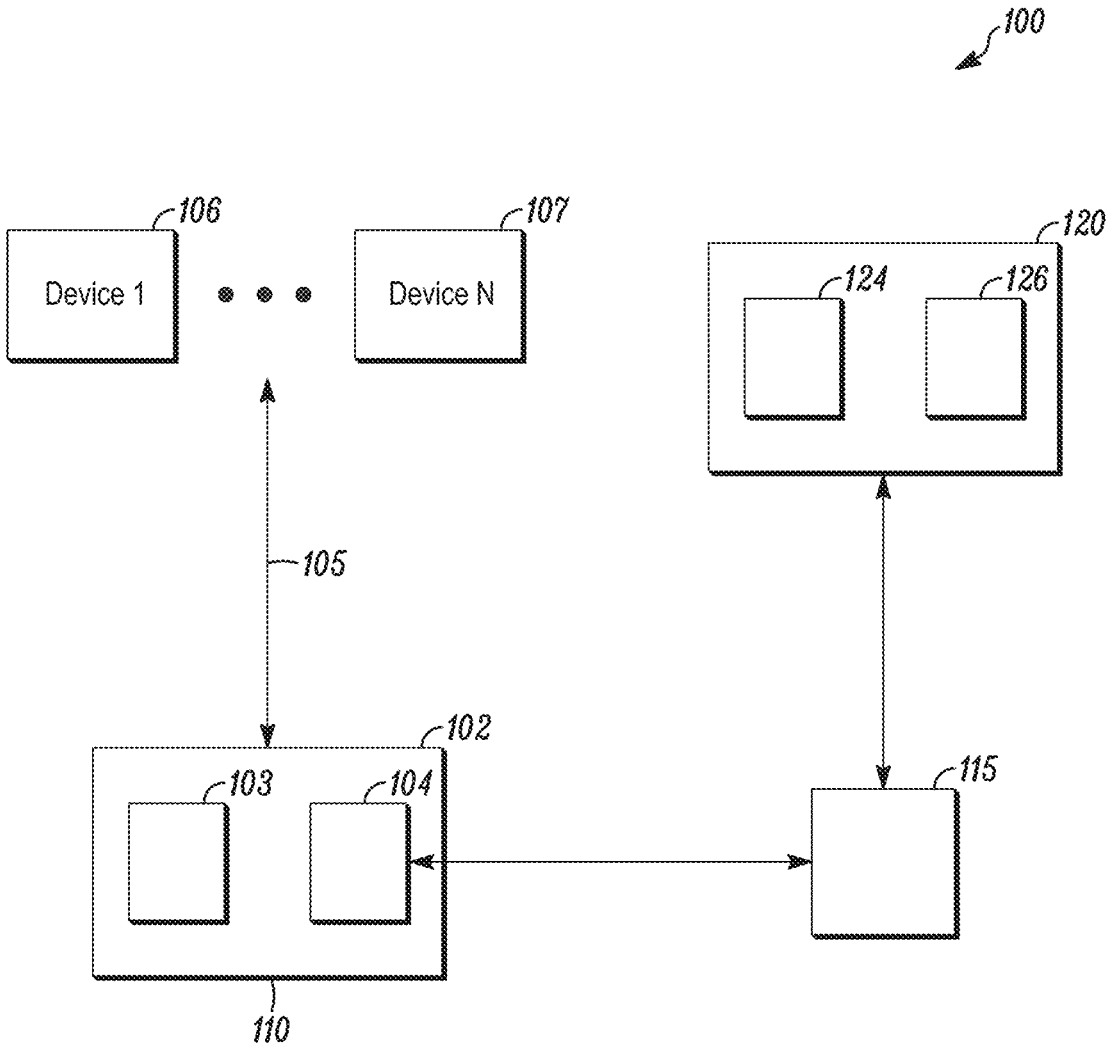
FIG. 1 is a diagram of an embodiment of a system that includes a tamper detection mechanism.

FIG. 1 illustrates one embodiment of a system 100 including a tamper detection mechanism. In the illustrated embodiment, the system 100 includes a control panel 102. The control panel 102 can be in communication with one or more devices 106, 107 in the system 100. Device 106 is shown as "device 1" and device 107 is shown as "device N" to illustrate that the control panel 102 can be in communication with any number of devices from one to N.

For example, each of the control panel 102 and the one or more devices 106, 107 can be located at a premise. The one or more devices 106, 107 can be configured to capture data, detect one or more predetermined conditions, and/or take a specified action at the premise. A communication link 105 between the control panel 102 and each of the one or more devices 106, 107 can facilitate signal communication between the control panel 102 and one or more of the devices 106, 107. The communication link 105 between the control panel 102 and each of the one or more devices 106, 107 can be a wireless communication link or wired communication link. Depending on the type of device 106, 107, the communication link 105 can be one-way from the control panel 102 to one or more devices 106, 107, one-way from one or more devices 106, 107 to the control panel 102, or two-way between the control panel 102 and one or more devices 106, 107. To facilitate signal communication over the communication link 105, each of the one or more devices 106, 107 can include a transmitter and/or receiver (e.g., a wireless transceiver) and the control panel 102 can include a transmitter and/or receiver (e.g., a wireless transceiver). As one example, the one or more devices 106, 107 can be one or more types of security devices, such as a door sensor, window sensor, glass break sensor, keypad, camera, motion detector, and/or smoke or fire detector, and/or one or more types of home automation devices, such as a thermostat, light switch, fan, appliance, blind controller, and/or asset protection devices.

The control panel 102 can include a housing 110. Within the housing 110 can be a non-transitory computer-readable storage article 103 and a controller 104. The controller 104 can be in communication with the non-transitory computer-readable storage article 103. In some embodiments, the non-transitory computer-readable storage article 103 is a memory such as flash memory, optical memory, magnetic memory, and read only memory (ROM). In some embodiments, the controller 104 can include a circuit board and/or one or more processors which, for instance, can include integrated circuits (e.g. FPGA, ASIC, microprocessor). In some embodiments, the controller 104 is part of a computing device. The non-transitory computer-readable storage article 103 can include computer-executable instructions which can be executed by the controller 104 (e.g., the one or more processors) to carry out the instructions. For example, the non-transitory computer-readable storage article 103 can store a computer program which the controller 104 of the control panel 102 can execute. Executing the computer-executable instructions can cause the controller 104 to perform various actions as suited for the application of the system 100.

The control panel 102 can be signal communication with a remote server 115. In the illustrated embodiment, the remote server 115 is further in signal communication with a remote user device 120. The remote user device 120 can include a second non-transitory computer-readable storage article 124 and one or more processors 126. In some embodiments, the devices 106, 107 and the control panel 102 can each be located at a common premise, while the remote server 120 can be at a location remote from, and different than, the premise. The remote user device 120 can, for example, be carried with a user such that remote user device 120 can be at the premise when the user is present at the premise and away from the premise when the user is away from the premise. The remote user device 120 can be, for instance, a mobile computing device, such as a smart phone or tablet, that executes a locally stored application and/or receives data wirelessly over a communication network to communicate with the control panel 102 via the remote server 115. In this way, the remote user device 120 can receive signals from the control panel 102 and can transmit signals to the control panel 102 (e.g., a command signal for the control panel 102 and/or one or more device 106, 107 to take a specified action). For example, the control panel 102 can send a tamper notification to the remote server 115 which can then send a corresponding tamper notification to the remote user device 120.

To enhance the security of the system 100, it can be useful to detect when there is an attempt to tamper with one or more items at the premise, such as the control panel 102 and/or the one or more devices 106, 107. For example, an intruder at the premise may attempt to defeat a security function of the system 100 by attempting to remove the control panel 102 and/or the one or more devices 106, 107 from a respective mounting surface. The intent in removing the panel and/or device(s) could be to terminate a power supply and/or a communication link at the panel and/or device(s). Accordingly, the ability to detect an attempt to tamper with one or more items at the premise can facilitate one or more actions within the system to try and thwart the tamper attempt or otherwise notify an appropriate contact as to the tamper attempt.

Figure 2:
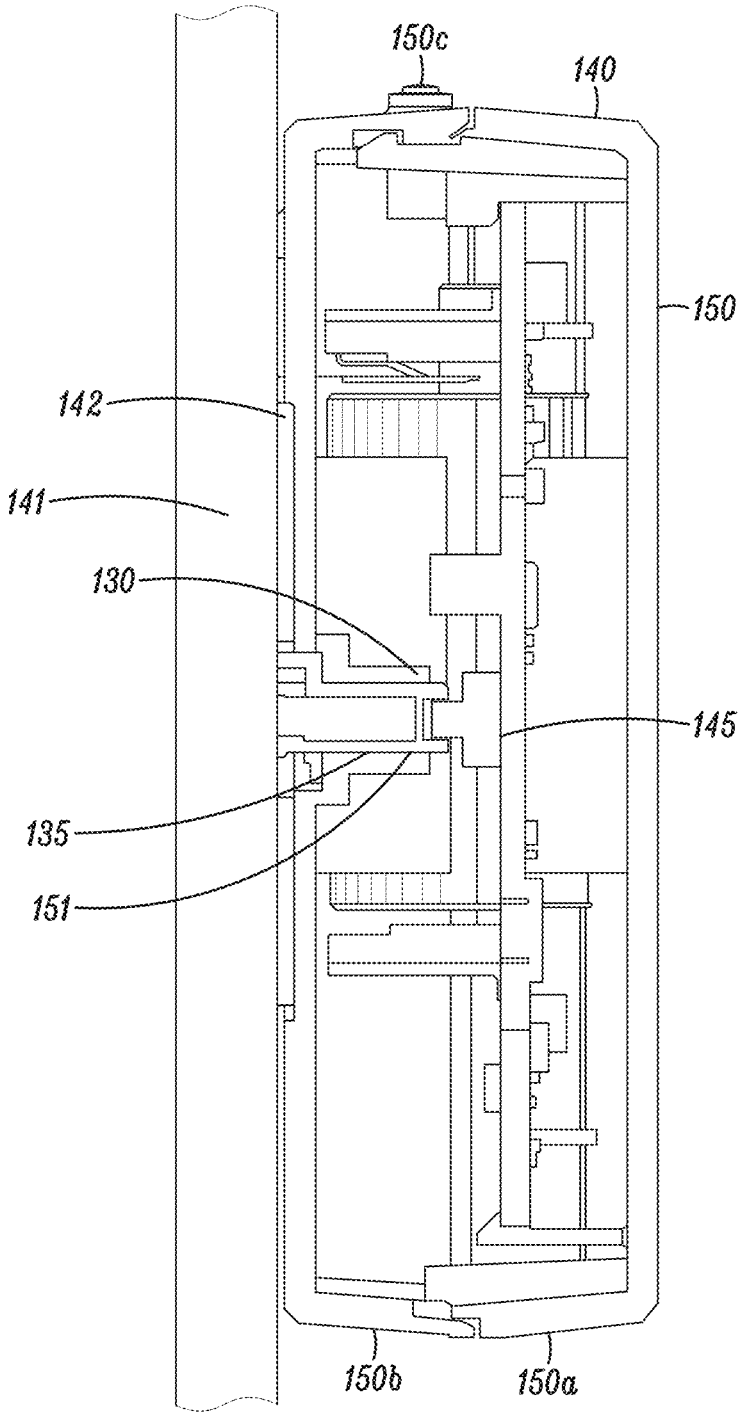
FIG. 2 is a cross-sectional view of an embodiment of a device that includes an embodiment of a tamper detection mechanism.
Figure 3:
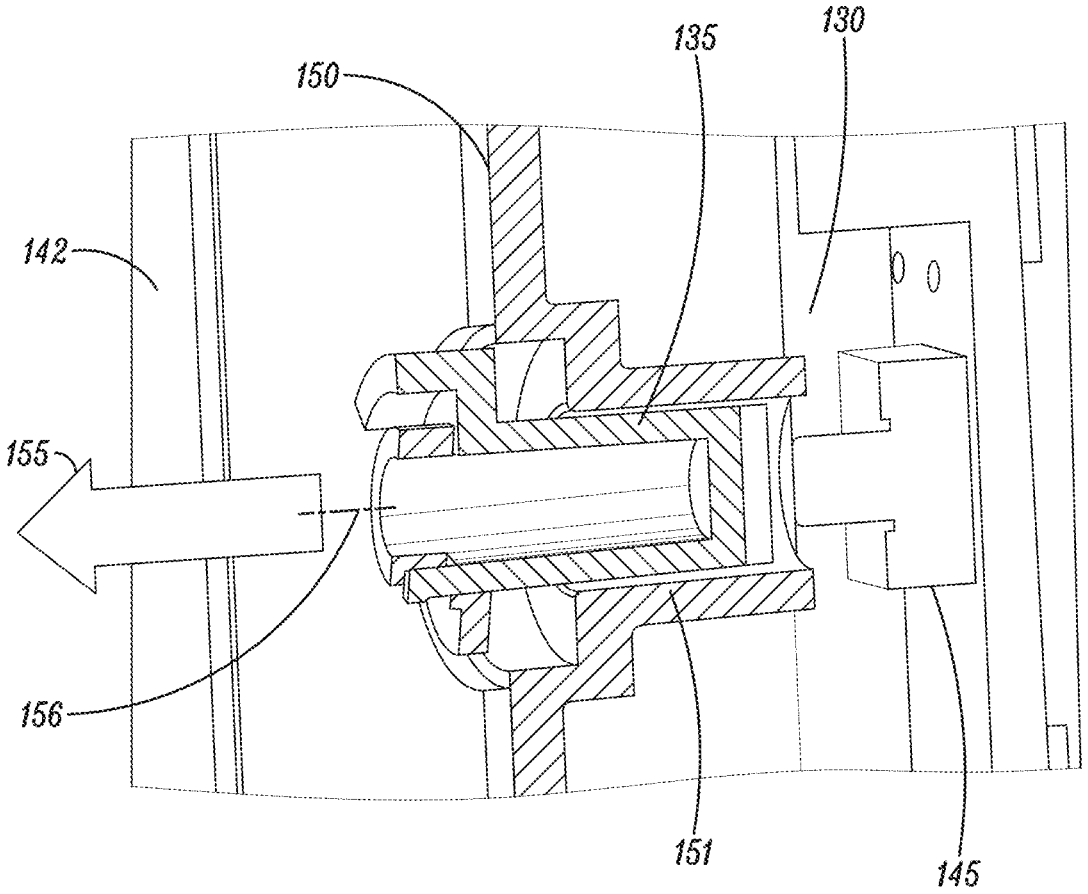
FIG. 3 is close-up cross-sectional view of the device of FIG. 2 with the tamper actuator at an exemplary tamper switch released position.

FIGS. 2 and 3 illustrate one exemplary embodiment of a tamper detection mechanism 130. Specifically, FIG. 2 is a cross-sectional view of an embodiment of a device 140 that includes the tamper detection mechanism 130. The tamper detection mechanism 130 can include a tamper actuator 135, and, in FIG. 2, the tamper actuator 135 of the tamper detection mechanism 130 is at an exemplary tamper switch engaged position. FIG. 3 is cross-sectional view of the device 140 with the tamper actuator 135 at an exemplary tamper switch released position. The device 140 can be, for example, any one or more of the items in the system of FIG. 1 such as the control panel and/or one or more of the devices (e.g., keypad) at the premise for which it may be desired to include a tamper detection functionality.

The device 140 can include a housing 150, and the tamper detection mechanism 130 can include a tamper switch 145 and the tamper actuator 135. The tamper switch 145 can be supported at the housing 150, and the tamper actuator 135 can be receivable at the housing 150.

As will be described further herein, the tamper actuator 135 can be movable between a tamper enabled position and a tamper disabled position. In the embodiment shown in FIGS. 2 and 3, the tamper actuator 135 in the tamper enabled position. When the tamper actuator 135 is in the tamper enabled position, as in the example of FIGS. 2 and 3, the tamper actuator 135 can be configured to move, relative to the housing 150, between a tamper switch engaged position, an example of which is shown in FIG. 2, and a tamper switch released position, an example of which is shown in FIG. 3. For example, the housing 150 can define a guide sleeve 151, and the tamper actuator 135 can be receivable at (e.g., and movable relative to) the guide sleeve 151. When the tamper actuator 135 is in the tamper enabled position, the tamper actuator 135 can be configured to move within the guide sleeve 151, relative to the housing 150, between the tamper switch engaged position, such as that shown in FIG. 2, and the tamper switch released position, such as that shown in FIG. 3. In the illustrated example, in the tamper switch engaged position, the tamper actuator 135 can contact the tamper switch 145, such as shown in FIG. 2, and in the tamper switch released position the tamper actuator 135 can be spaced apart from the tamper switch 145, such as shown in FIG. 3. Though in other embodiments within the scope of the present disclosure, the tamper actuator 135 may not itself directly contact the tamper switch 145 in the tamper switch engaged position.

When in the tamper enabled position, movement of the tamper actuator 135 from the tamper switch engaged position to the tamper switch released position can actuate the tamper switch 145. For example, as shown in FIG. 2, the device 140 is mounted at a mounting surface 141. In the illustrated embodiment the device 140 is mounted to the mounting surface 141 via adhesive foam tape 142. When the device 140 is mounted at the mounting surface 141, a contact force applied by the mounting surface 141 at the device 140 can keep the tamper actuator 135 in the tamper switch engaged position, as shown in FIG. 2. Specifically, in the illustrated embodiment of FIG. 2, the contact force is applied by the mounting surface 141 at the tamper actuator 135 which, in turn, acts to maintain the tamper actuator 135 in the tamper switch engaged position. Upon removing the housing 150 from the mounting surface 141, the device 140, and its tamper mechanism 130, is configured to actuate the tamper switch 145. Specifically, in the illustrated embodiment of FIG. 3, upon removing the housing 150 from the mounting surface 141, sufficient contact force applied by the mounting surface 141 is no longer present and, as a result, the tamper actuator 135 moves to the tamper switch released position. Movement of the tamper actuator 135 from the tamper switch engaged position to the tamper switch released position can actuate the tamper switch 145 and, as a result, cause the device 140 to generate a tamper signal.

In the illustrated embodiment, the tamper actuator 135 is configured to move in a direction 155 between the tamper switch engaged position and the tamper switch released position. The direction 155 in which the tamper actuator 135 moves between the tamper switch engaged position and the tamper switch released position can be a translational direction. In particular, the tamper actuator 135 can have a longitudinal axis 156, and the tamper actuator 135 can be configured to move between the tamper switch engaged position and the tamper switch released position in the translational direction 155 that is along the longitudinal axis 156 of the tamper actuator 135. When the tamper actuator 135 moves from the tamper switch engaged position to the tamper switch released position, the tamper actuator 135 can move in the translational direction 155 away from the housing 150 (e.g., away from the tamper switch 145). And, when the tamper actuator 135 moves from the tamper switch released position to the tamper switch engaged position, the tamper actuator 135 can move in the translational direction 155 toward the housing 150 (e.g., toward the tamper switch 145).

In the illustrated embodiment, in addition to the device 140 being configured to actuate the tamper switch 145 upon the housing 150 being removed from the mounting surface 141, the device 140 can also be configured to actuate the tamper switch 145 upon a portion of the housing 150 being opened. For example, the housing 150 can include a first housing portion 150*a* and a second housing portion 150*b*. The first and second housing portions 150*a*, 150*b* can be secured together via a housing closure element 150*c* to close the housing 150. Upon the a portion of the housing 150 (e.g., the first housing portion 150*a*) being opened relative to another portion of the housing 150 (e.g., the second housing portion 150*b*), for instance as a result of the housing closure element 150*c* being removed, the device 140 can actuate the tamper switch 145. As seen in the example of FIG. 2, the tamper switch 145 is secured at the housing 150 at the first housing portion 150*a* while the tamper actuator 135 is received at the housing 150 at the second housing portion 150*b*. As such, the tamper switch 145 and the tamper actuator 135 can be at housing portions that are movable relative to one another, such as when the housing closure element 150*c* is removed. As a result of this configuration, when the tamper actuator 135 is in the tamper enabled position and tamper switch engaged position, such as shown in FIG. 2, opening a portion of the housing 150 (e.g., the second housing portion 150*b*) can cause the tamper switch 145 to be actuated. Thus, the device 140 can be configured, for instance when the tamper actuator 135 is in the tamper enabled position, to actuate the tamper switch 145 upon either of the housing 150 being removed from the mounting surface 141 at which the housing 150 is mounted or a portion of the housing 150 being opened.

Figure 4A:
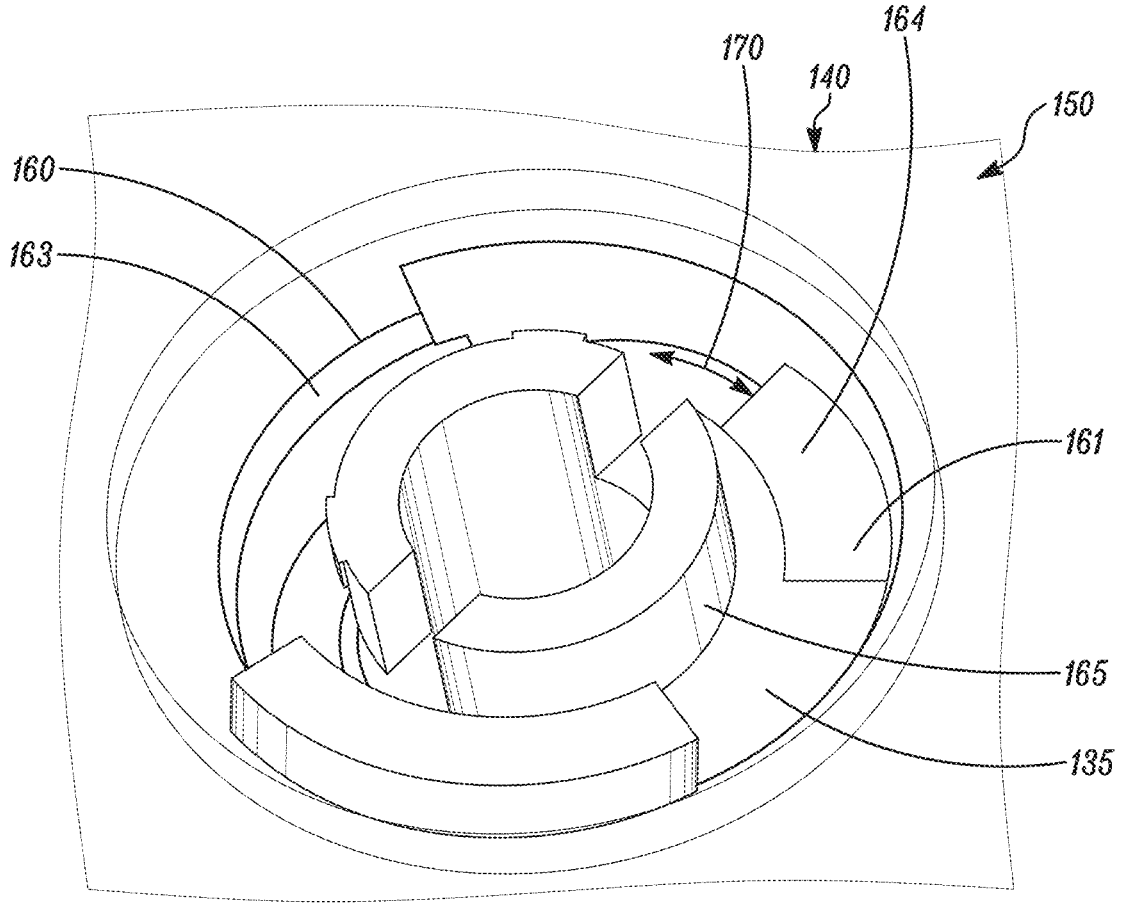
FIG. 4A is a perspective view of the device of FIG. 2 with the tamper actuator at an exemplary tamper enabled position.

FIG. 4A is a perspective view of the device 140 with the tamper actuator 135 at an exemplary tamper enabled position. When the tamper actuator 135 is at the tamper enabled position, the tamper detection functionality associated with the tamper mechanism 130 can be enabled. Namely, as noted, when the tamper actuator 135 is in the tamper enabled position, the tamper actuator 135 is configured to move, relative to the housing 150, between the tamper switch engaged position and the tamper switch released position. As shown here, the housing 150 can include a first locking feature 160 and the tamper actuator 135 can include a second locking feature 161 that is complementary to the first locking feature 160. When the tamper actuator 135 is in the tamper enabled position, the first locking feature 160 and the second locking feature 161 can be disengaged. Disengagement between the first locking feature 160 and the second locking feature 161, as in the tamper enabled position, can permit the tamper actuator 135 to move, relative to the housing 150, between the tamper switch engaged position, such as in FIG. 2, and the tamper switch released position, such as in FIG. 3.

Figure 4B:
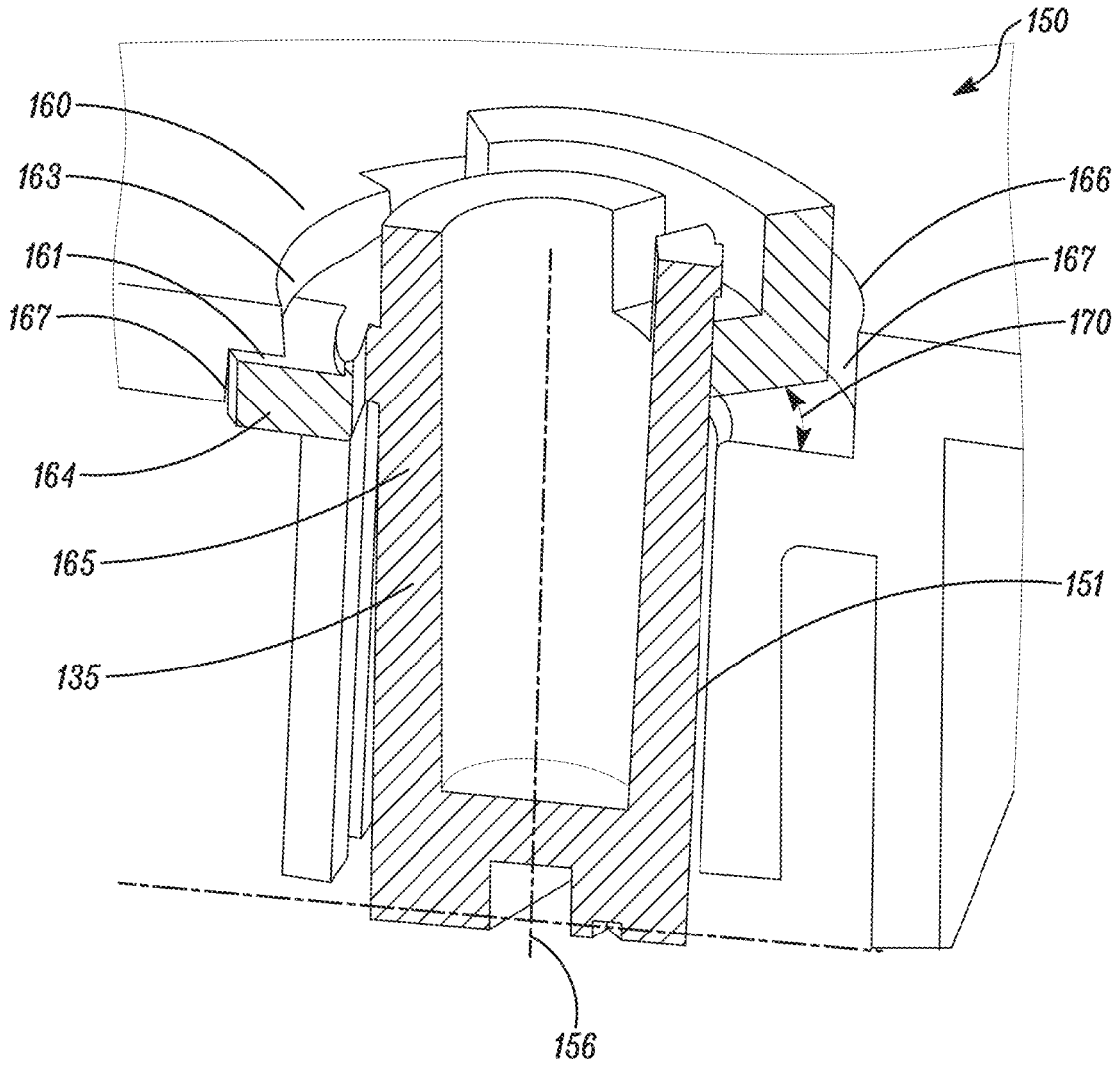
FIG. 4B is a cross-sectional view of the device of FIG. 2 with the tamper actuator at an exemplary tamper disabled position.

FIG. 4B is a cross-sectional of the device 140 with the tamper actuator 135 at an exemplary tamper disabled position. When the tamper actuator 135 is at the tamper disabled position, the tamper detection functionality associated with the tamper mechanism 130 can be disabled. Namely, when the tamper actuator 135 is in the tamper disabled position, the tamper actuator 135 can be fixed in place at the housing 150. More specifically, when the tamper actuator 135 is in the tamper disabled position, the tamper actuator 135 can be fixed in place at the housing 150 so as to prohibit movement of the tamper actuator 135 relative to the tamper switch 145. When the tamper actuator 135 is in the tamper disabled position, the second locking feature 161, of the tamper actuator 135, can engage the first locking feature 160, of the housing 150, to fix the tamper actuator 135 in place at the housing 150. Engagement between the first locking feature 160 and the second locking feature 161, as in the tamper disabled position, can prohibit the tamper actuator 135 from moving, relative to the housing 150, between the tamper switch engaged position, such as in FIG. 2, and the tamper switch released position, such as in FIG. 3. This fixation of the tamper actuator 135 in place at the housing 150 in the tamper disabled position can act to disable the tamper detection functionality associated with the tamper mechanism 130.

In the illustrated embodiment of FIG. 4B, the second locking feature 161, of the tamper actuator 135, engages the first locking feature 160, of the housing 150, via an interference fit. As shown here, the first locking feature 160 includes a locking tab 163 defined at the housing 150. As also shown here, the second locking feature 161 includes a flange 164 extending outward from a body 165 of the tamper actuator 135. The flange 164 engages the locking tab 163 to create an interference fit, and this interference fit between the locking tab 163 and the flange 164 can fix the tamper actuator 135 in place at the housing 150.

In order to selectively enable the tamper detection functionality of the tamper mechanism 130, the tamper actuator 135 can be moved between the tamper enabled position, such as shown in FIG. 4A, and the tamper disabled position, such as shown in FIG. 4B. In the illustrated embodiment, the tamper actuator 135 can be configured to move in a direction 170 between the tamper disabled position and the tamper enabled position. The direction 170, in which the tamper actuator 135 is configured to move between tamper disabled position and the tamper enabled position, can be a different direction than the direction 155, in which the tamper actuator 135 is configured to move between the tamper switch engaged position and the tamper switch released position. For example, the direction 170, in which the tamper actuator 135 is configured to move between tamper disabled position and the tamper enabled position, can include a rotational direction about the longitudinal axis 156 of the tamper actuator 135. On the other hand, as described previously, the direction 155, in which the tamper actuator 135 is configured to move between the tamper switch engaged position and the tamper switch released position, can include a translational direction along the longitudinal axis 156 of the tamper actuator 135. Thus, in some such examples, the direction 155 can be along a direction that is generally perpendicular to a plane in which movement in direction 170 occurs.

In comparing the tamper enabled position, such as shown in FIG. 4A, to the tamper disabled position, such as shown in FIG. 4B, the tamper actuator 135 can be seen at different rotational positions relative to the housing 150. In particular, in the tamper enabled position, the tamper actuator 135 is at a rotational position, about the longitudinal axis 156 of the tamper actuator 135 and relative to the housing 150, such that the second locking feature 161, of the tamper actuator 135, is disengaged from the first locking feature 160, of the housing 150. And, in the tamper disabled position, the tamper actuator 135 is at a different position, about the longitudinal axis 156 of the tamper actuator 135 and relative to the housing 150, such that the second locking feature 161, of the tamper actuator 135, engages the first locking feature 160. Moving the tamper actuator 135 in the rotational direction 170 from the tamper enabled position to the tamper disabled position can cause the first and second locking features 160, 161 to engage and thereby hold the tamper actuator 135 in place relative to the tamper switch 145. Namely, the flange 164, of the tamper actuator 135, can be brought into engagement with the locking tab 163 when the tamper actuator 135 is moved in the rotational direction 170 from the tamper enabled position to the tamper disabled position. Likewise, the flange 164, of the tamper actuator 135, can be disengaged from the locking tab 163 when the tamper actuator 135 is moved in the rotational direction 170 from the tamper disabled position to the tamper enabled position.

Figure 5:
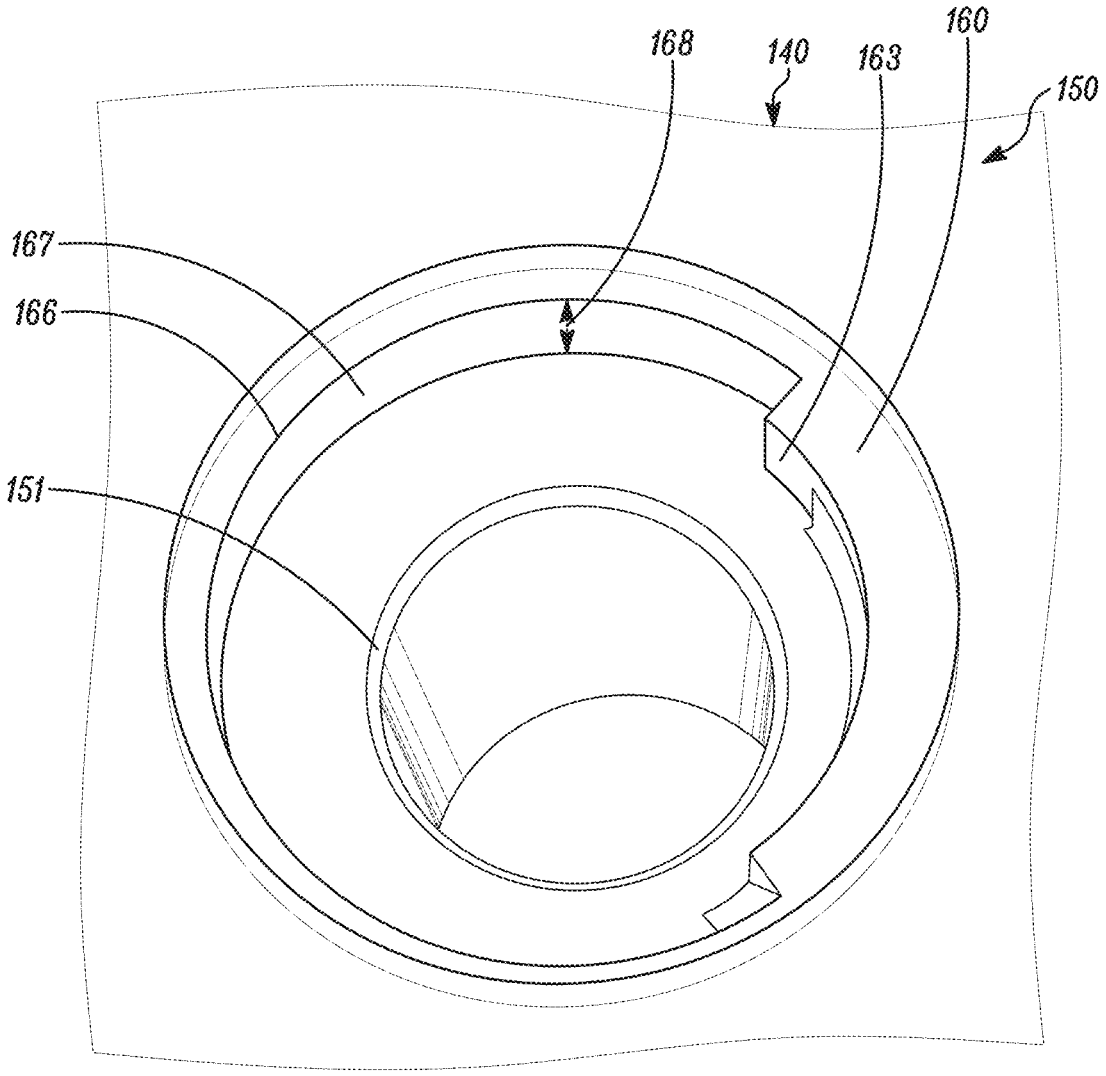
FIG. 5 is a perspective view of the device of FIG. 2 with an embodiment of a first locking feature at a housing of the device.

FIG. 5 is a perspective view of the housing 150 of the device 140 showing the first locking feature 160 of the housing 150. The housing 150 can define an entry aperture 166 that leads to the guide sleeve 151. The first locking feature 160, here including the locking tab 163, can extend into the entry aperture 166. Specifically, the entry aperture 166 can be defined by an entry sidewall 167, and the first locking feature 160 can extend out from the entry sidewall 167 into the entry aperture 166. The locking tab 163 can be defined along a portion of the entry sidewall 167 such that some of the entry sidewall 167 includes the locking tab 163 and some of the entry sidewall 167 does not include the locking tab 163. In other words, some, but not all, of a circumferential span of the entry sidewall 167 can include the locking tab 163. In the illustrated embodiment, the locking tab 163 extends around less than half of the entry sidewall 167. With the locking tab 163 present, the entry aperture 166 has a reduced width at locations of the locking tab 163. In addition, the locking tab 163 can extend along a portion, but not all, of a length 168 (e.g., in a direction parallel to the longitudinal axis of the tamper actuator) of the entry sidewall 167. As can be best seen in FIG. 4B, the locking tab 163 can terminate prior to an end of the entry sidewall 167 such that the locking tab 163 extends along less than an entire length 168 of the entry sidewall 167. In this way, the locking tab 163 and entry sidewall 167 can together create a slot, as can be seen in FIG. 4B, for receiving the flange 164.

Figure 6:
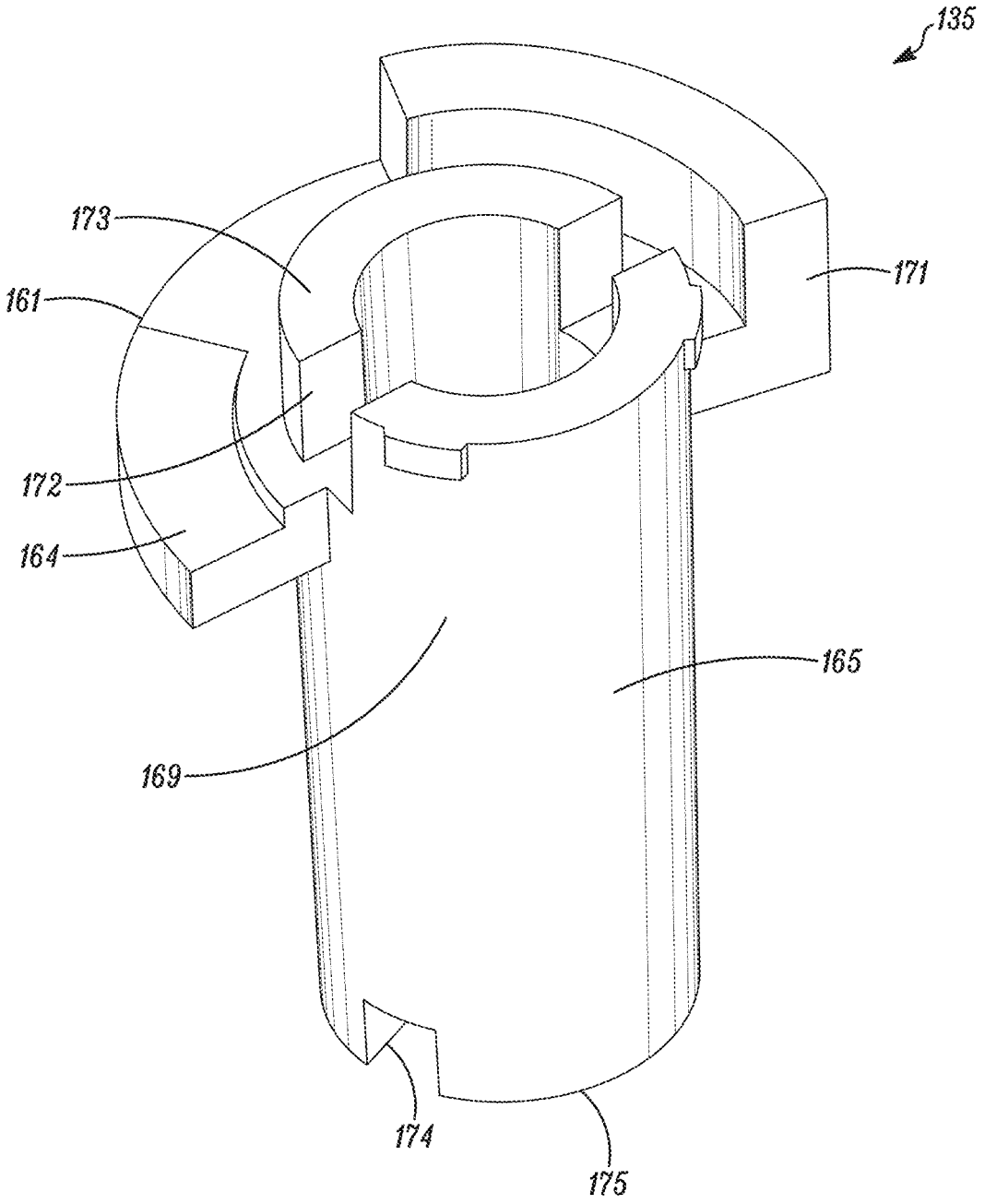
FIG. 6 is a perspective view of the tamper actuator of the device of FIG. 2.

FIG. 6 is a perspective view of the tamper actuator 135 in isolation. As noted, the tamper actuator 135 includes the body 165. The second locking feature 161, of the tamper actuator 135 includes the flange 164. The flange 164 extends out from the body 165 of the tamper actuator to create an engagement interface complementary to the first locking feature 160 of the housing 150. As shown here, the flange 164 extends around less than half of a circumferential perimeter of the body 165 leaving a portion 169 of the body 165, at a common elevation of the flange 164, without the flange 164. Thus, at this elevation on the body 165 where the flange 164 is located, the tamper actuator 135 includes a varied width with the width at the location of the flange being greater than the width at the portion 169. This varied width can help to facilitate selective engagement and disengagement between the first and second locking features 160, 161.

The tamper actuator 135 can also include a rotational stop 171. The rotational stop 171 can extend upward, relative to the flange 164, and be spaced apart from, in circumferential direction, the portion of the flange 164 that is to engage the first locking feature 160 at the housing 150. The rotational stop 171 can be configured to contact the locking tab 163, without fixing the tamper actuator 135 in place at the housing 150, when the tamper actuator 135 is brought to the tamper enabled position. As such, the rotational stop 171 can serve as a tactile feedback mechanism to a user to convey that the tamper actuator 135 has been brought to the tamper enabled position.

As can also be seen in FIG. 6, the tamper actuator 135 can include one or more tool engagement features. In the illustrated embodiment, the tamper actuator 135 include a first tool engagement feature 172 at or near a top portion 173 of the tamper actuator 135 and a second tool engagement feature 174 at or near a bottom portion 175 of the tamper actuator 135. In the example shown here, each tool engagement features 172, 173 includes a pair of aligned slots extending, for instance, in a direction parallel to the longitudinal axis of the tamper actuator 135 from the respective top portion 173 and bottom portion 175. The tool engagement feature 172, 173 can be configured to receive a tool mechanism for assisting in moving (e.g., rotationally moving) the tamper actuator 135 between the tamper enabled and tamper disabled positions.

Figure 7A:
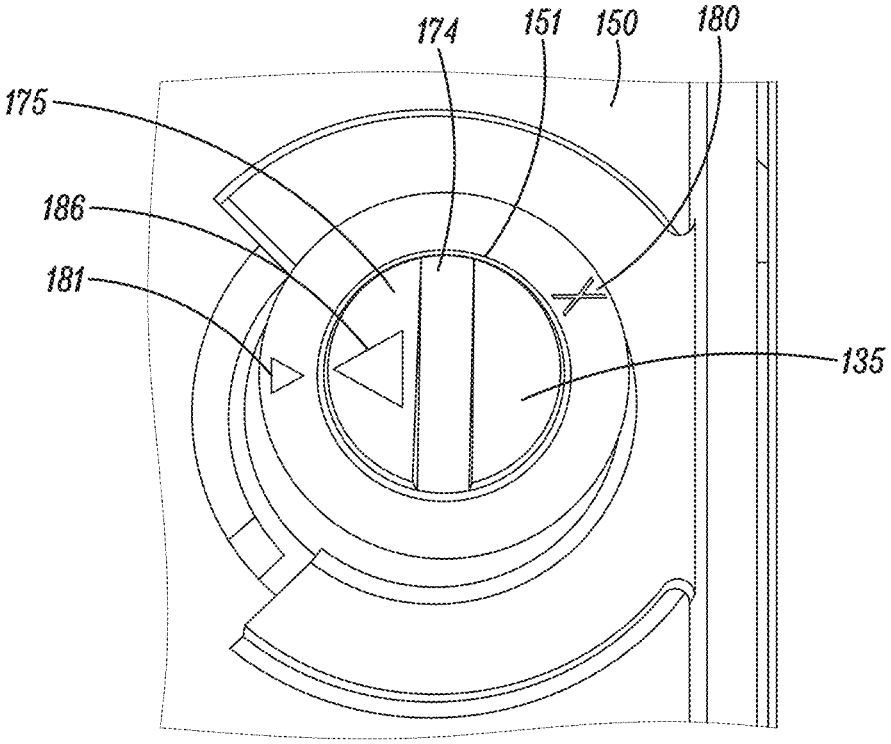
FIG. 7A is plan view of an embodiment of a positional indicator of the tamper actuator aligned with a tamper enabled indicator at the housing of the device of FIG. 2.
Figure 7B:
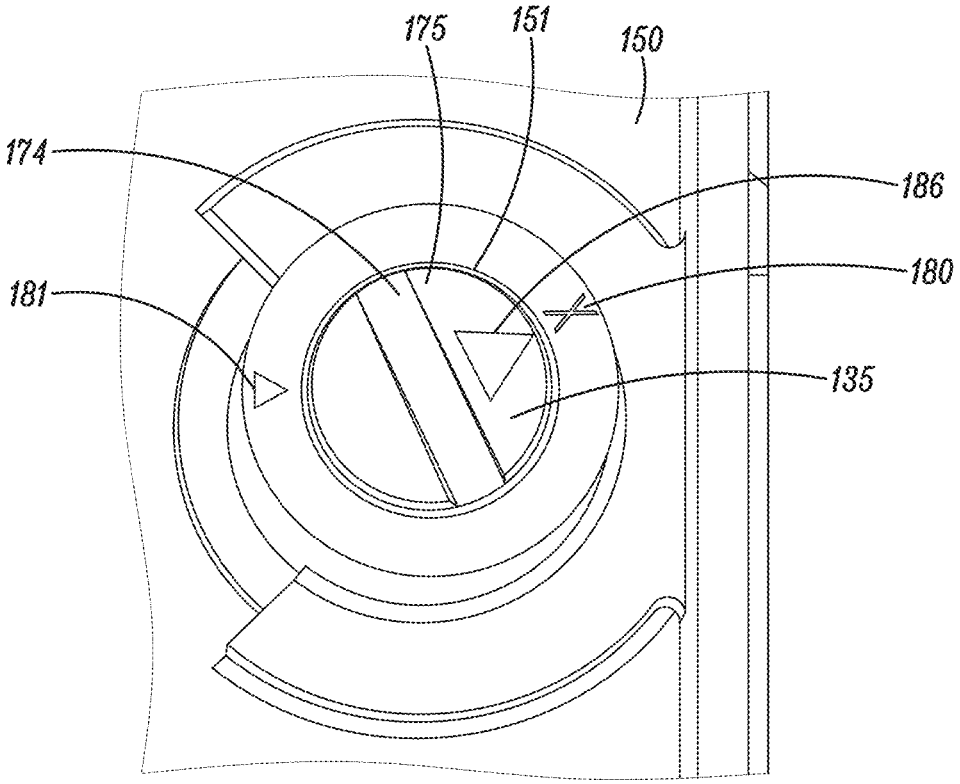
FIG. 7B is a plan view of an embodiment of a positional indicator of the tamper actuator aligned with a tamper disabled indicator at the housing of the device of FIG. 2.

FIGS. 7A and 7B are plan views of exemplary tamper disabled and tamper enabled indicators 180, 181. As shown here, the housing 150 can include a tamper disabled indicator 180 and/or a tamper enabled indicator 181. The tamper disabled indicator 180 can be at a first location on the housing 150 while the tamper enabled indicator 181 can be at a second location on the housing 150, with the second location being spaced apart along the housing 150 from the first location. The tamper disabled indicator 180 can correspond to a rotational position of the tamper actuator 135 in the tamper disabled position, such as the rotational position of the tamper actuator 135 shown in FIG. 4B. The tamper enabled indicator 181 can correspond to another, different rotational position of the tamper actuator 135 in the tamper enabled position, such as the rotational position of the tamper actuator 135 shown in FIG. 4A. As described previously, the rotational position of the tamper actuator 135 in the tamper disabled position can be rotationally offset, in a direction about the longitudinal axis 156 of the tamper actuator 135, from the rotational position of the tamper actuator 135 in the tamper enabled position. Accordingly, the location of the tamper disabled indicator 180 can be offset, about the housing 150, in a direction corresponding to the different rotational positions of the tamper actuator 135 in the tamper disabled and tamper enabled positions.

The exemplary tamper disabled and tamper enabled indicators 180, 181 can be helpful in assisting a user to appropriately position the tamper actuator 135 in a desired tamper disabled and tamper enabled position. To do so, the tamper actuator 135 can include a positional indicator 186, for instance at or near the bottom portion 175 of the tamper actuator 135. As shown in FIG. 7A, the positional indicator 186 can be aligned with the tamper enabled indicator 181 when the tamper actuator 135 is at the rotational position corresponding to the tamper enabled position of the tamper actuator 135. And, as shown in FIG. 7B, the positional indicator 186 can be aligned with the tamper disabled indicator 180 when the tamper actuator 135 is at the rotational position corresponding to the tamper disabled position of the tamper actuator 135. Thus, when a user desires to move the tamper actuator 135 between the tamper enabled and tamper disabled positions, the user can utilize the location of the positional indicator 186 on the tamper actuator 135 relative to tamper disabled and tamper enabled indicators 180, 181 as a visual guide for moving the tamper actuator 135 to the desired position.

Figure 8:
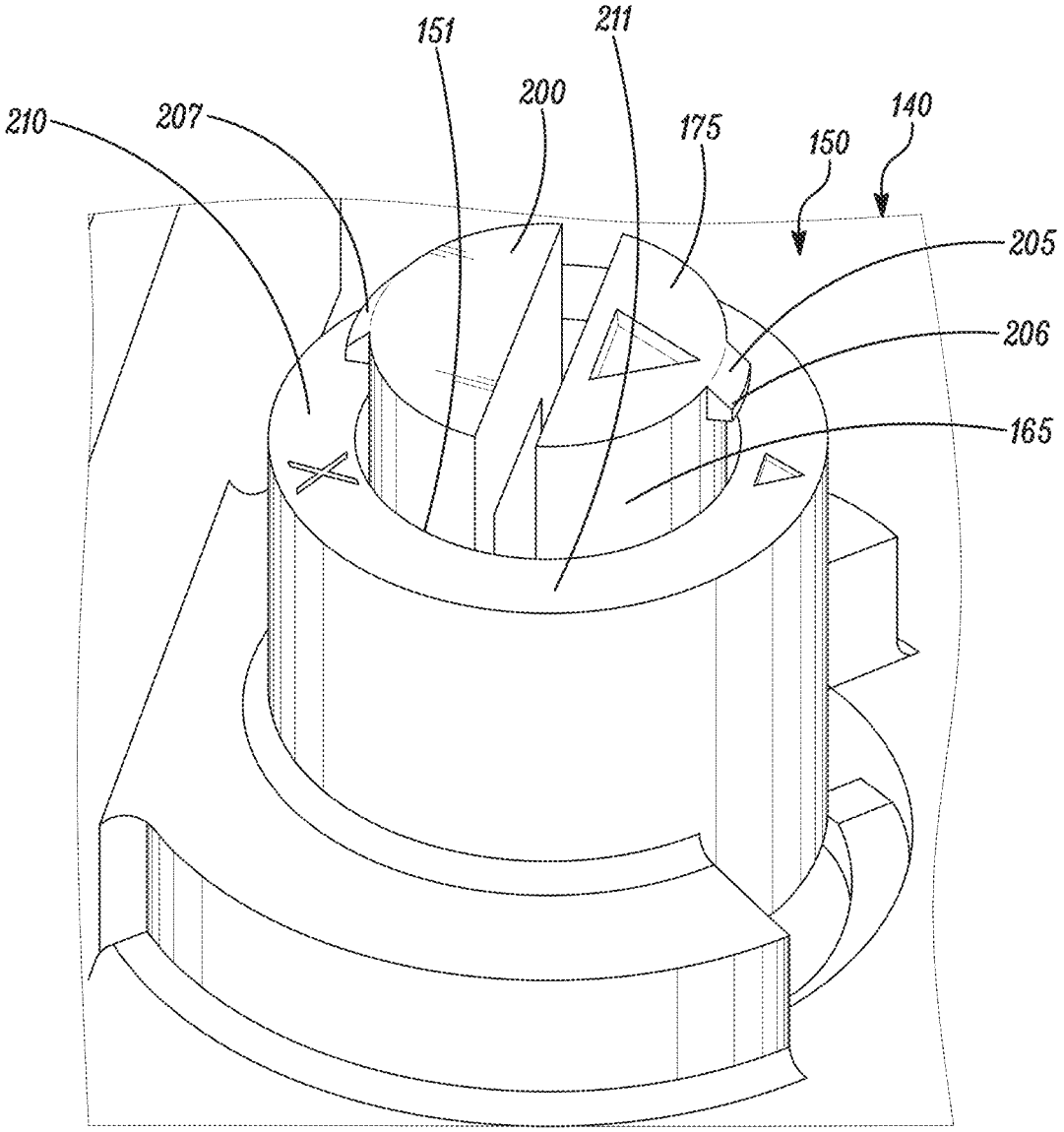
FIG. 8 is perspective view of another embodiment of a tamper actuator at the housing of the device of FIG. 2.

FIG. 8 is a perspective view of another embodiment of a tamper actuator 200. The tamper actuator 200 is shown here at the housing 150 of the device 140. The tamper actuator 200 can be the same as, or similar to, the tamper actuator 135 illustrated and described previously herein, except that the tamper actuator 200 can include a retention feature 205. The housing 150 can also include a retention feature 210. The retention feature 205, at the tamper actuator 200, can be complementary to the retention feature 210, at the housing 150 so as to allow for engagement between the retention features 205, 210 which can act to retain the tamper actuator 200 at the housing 150. More specifically, when the tamper actuator 200 is in the tamper enabled position, the retention feature 205 can engage the retention feature 210 to maintain the tamper actuator 200 at the housing 150, for instance within the guide sleeve 151 of the housing 150 in the example shown here. Thus, since the tamper actuator 200 is movable relative to the housing 150 when in the tamper enabled position, the presence, and engagement of, the complementary retention features 205, 210 can help to retain the tamper actuator 200 at the housing 150 by, for instance, preventing the tamper actuator 200 from falling out of the housing 150 during movement when in the tamper enabled position.

In the illustrated embodiment, the retention feature 205, of the tamper actuator 200, includes a first retention flange 206 and a second retention flange 207. Each of the first retention flange 206 and the second retention flange 207 extends out from the body 165 of the tamper actuator 200 in a direction perpendicular to the longitudinal axis of the tamper actuator 200. For instance, as shown here, each of the first retention flange 206 and the second retention flange 207 extends out from the body 165 of the tamper actuator 200 at, or near, the bottom portion 175 of the tamper actuator 200. The first retention flange 206 and the second retention flange 207 are located at opposite sides of the body 165 of the tamper actuator 200. Also in the illustrated embodiment, the retention feature 210, of the housing 150, is formed at the guide sleeve 151 of the housing 150. For instance, as shown here, the retention feature 210 can be formed at an end of the guide sleeve 151 via an elbow surface 211 present at the end of the guide sleeve 151. This elbow surface 211 can extend out from the guide sleeve 151 an extent similar to (e.g., equal to or greater than) the extent to which the first retention flange 206 and the second retention flange 207 extend out from the body 165 of the tamper actuator 200 so as to provide an appropriate seating surface for these retention flanges 206, 207.

Figure 9:
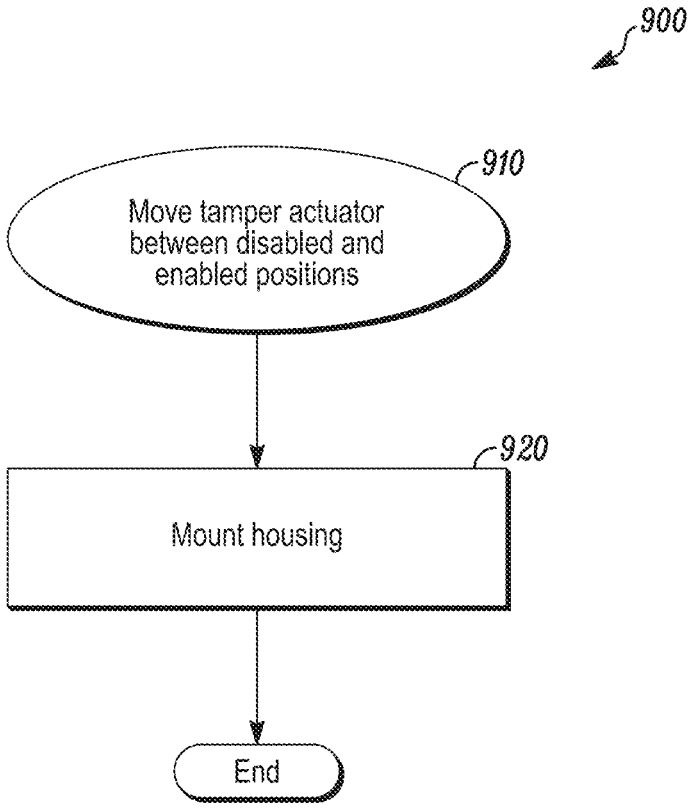
FIG. 9 is a flow diagram of an embodiment of a method of mounting a housing that includes a tamper detection mechanism.

FIG. 9 is a flow diagram of an embodiment of a method 900 of mounting a housing that includes a tamper detection mechanism. The housing and/or tamper detection mechanism referenced in the method 900 can be the same as, or similar to, any one or more of the housing and/or tamper mechanism embodiments illustrated and described elsewhere herein, including any one or more of the tamper actuator embodiments illustrated and described elsewhere herein.

At step 910, the method 900 includes the step of moving a tamper actuator in a first direction, relative to the housing that includes a tamper switch, between a tamper disabled position and a tamper enabled position. In the tamper disabled position, the tamper actuator can be fixed in place at the housing. In the tamper enabled position, the tamper actuator can be configured to move in a second direction relative, relative to the housing, between a tamper switch engaged position and a tamper switch released position. In one embodiment, the housing can define a guide sleeve, and the tamper actuator can be received at the guide sleeve. In such embodiment, when the tamper actuator is in the tamper enabled position, the tamper actuator is configured to move in the second direction, within the guide sleeve relative to the housing, between the tamper switch engaged position and the tamper switch released position.

The second direction can be different than the first direction. As one example, the first direction can include a rotational direction about a longitudinal axis of the tamper actuator, and the second direction can include a translational direction along the longitudinal axis of the tamper actuator. In some embodiments, the housing can include a first locking feature, and the tamper actuator can include a second locking feature that is complementary to the first locking feature. And, in these such embodiment, moving the tamper actuator in the first direction to the tamper disabled position can include engaging the second locking feature with the first locking feature to fix the tamper actuator in place at the housing. For instance, the second locking feature can engage the first locking feature when the tamper actuator is at a first rotational position relative to the housing, and the second locking feature can be disengaged from the first locking feature when the tamper actuator is at a second rotational position relative to the housing, where the second rotational position is different than the first rotational position.

At step 920, the method 900 includes the step of mounting the housing at a mounting surface. For instance, the housing can be mounted at the mounting surface using adhesive foam tape or other appropriate mounting mechanism suited for the particular application. As described elsewhere herein, embodiments of the tamper mechanism can be configured to actuate the tamper switch (e.g., and detect housing removal from the mounting surface) without requiring more intrusive mounting mechanism(s) between the housing and the mounting surface. In this way, tamper detection mechanism embodiments disclosed herein can reduce the structural impact associated with mounting the housing at a mounting surface and increase the types of mounting surfaces at which the housing can be mounted.

As one example, when the tamper actuator is in the tamper enabled position, the tamper switch can be actuatable by either removing the housing from the mounting surface at which the housing is mounted or opening a portion of the housing.

Various examples have been described. These and other examples are within the scope of the following claims.

What is claimed is:

1. A device comprising:

a housing;

a tamper switch supported at the housing; and a tamper actuator receivable at the housing, wherein the tamper actuator is movable between a tamper disabled position and a tamper enabled position, wherein in the tamper disabled position the tamper actuator is fixed in place at the housing, wherein in the tamper enabled position the tamper actuator is configured to move relative to the housing between a tamper switch engaged position and a tamper switch released position, wherein the housing comprises a first locking feature, wherein the tamper actuator comprises a second locking feature that is complementary to the first locking feature, and wherein when the tamper actuator is in the tamper disabled position the second locking feature engages the first locking feature to fix the tamper actuator in place at the housing.

2. The device of claim 1, wherein in the tamper switch engaged position the tamper actuator contacts the tamper switch, and wherein in the tamper switch released position the tamper actuator is spaced apart from the tamper switch.

3. The device of claim 1, wherein the tamper actuator is configured to move in a first direction between the tamper disabled position and the tamper enabled position, and wherein the tamper actuator is configured to move in a second direction between the tamper switch engaged position and the tamper switch released position, the second direction being different than the first direction.

4. The device of claim 3, wherein the first direction comprises a rotational direction about a longitudinal axis of the tamper actuator, and wherein the second direction comprises a translational direction along the longitudinal axis of the tamper actuator.

5. The device of claim 1, wherein in the tamper disabled position the tamper actuator is fixed in place at the housing so as to prohibit movement of the tamper actuator relative to the tamper switch.

6. The device of claim 1, wherein the second locking feature engages the first locking feature when the tamper actuator is at a first rotational position relative to the housing, and wherein the second locking feature is disengaged from the first locking feature when the tamper actuator is at a second rotational position relative to the housing, the second rotational position being different than the first rotational position.

7. The device of claim 6, wherein the first locking feature comprises a locking tab defined at the housing, wherein the second locking feature comprises a flange extending outward from a body of the tamper actuator, and wherein the second locking feature engages the first locking feature via an interference fit between the locking tab and the flange to fix the tamper actuator in place at the housing.

8. The device of claim 1, wherein, when the tamper actuator is in the tamper enabled position, the device is configured to actuate the tamper switch upon either of the housing being removed from a mounting surface at which the housing is mounted or a portion of the housing being opened.

9. The device of claim 1, wherein the housing defines a guide sleeve, wherein the tamper actuator is receivable at the guide sleeve, and wherein, when the tamper actuator is in the tamper enabled position, the tamper actuator is configured to move within the guide sleeve relative to the housing between the tamper switch engaged position and the tamper switch released position.

10. The device of claim 9, wherein the guide sleeve comprises a first retention feature, wherein the tamper actuator comprises a second retention feature that is complementary to the first retention feature, and wherein, when the tamper actuator is in the tamper enabled position, the second retention feature engages the first retention feature to maintain the tamper actuator within the guide sleeve.

11. The device of claim 1, wherein the housing further comprises:

a tamper disabled indicator at a first location on the housing; and a tamper enabled indicator at a second location on the housing, the second location being spaced apart along the housing from the first location.

12. A device comprising:

a housing, wherein the housing further comprises:

a tamper disabled indicator at a first location on the housing; and a tamper enabled indicator at a second location on the housing, the second location being spaced apart along the housing from the first location;

a tamper switch supported at the housing; and a tamper actuator receivable at the housing, wherein the tamper actuator is movable between a tamper disabled position and a tamper enabled position, wherein in the tamper disabled position the tamper actuator is fixed in place at the housing, wherein in the tamper enabled position the tamper actuator is configured to move relative to the housing between a tamper switch engaged position and a tamper switch released position.

13. The device of claim 12, wherein the tamper disabled indicator corresponds to a first rotational position of the tamper actuator in the tamper disabled position, and wherein the tamper enabled indicator corresponds to a second rotational position of the tamper actuator in the tamper enabled position, the first rotational position being rotationally offset from the second rotational position about a longitudinal axis of the tamper actuator.

14. The device of claim 13, wherein the tamper actuator comprises a positional indicator, wherein the positional indicator is aligned with the tamper disabled indicator when the tamper actuator is at the first rotational position, and wherein the positional indicator is aligned with the tamper enabled indicator when the tamper actuator is at the second rotational position.

15. The device of claim 12, wherein the housing comprises a first locking feature, wherein the tamper actuator comprises a second locking feature that is complementary to the first locking feature, and wherein when the tamper actuator is in the tamper disabled position the second locking feature engages the first locking feature to fix the tamper actuator in place at the housing.

16. A method comprising the steps of:

moving a tamper actuator in a first direction, relative to a housing that includes a tamper switch, between a tamper disabled position and a tamper enabled position, wherein in the tamper disabled position the tamper actuator is fixed in place at the housing, wherein in the tamper enabled position the tamper actuator is configured to move in a second direction, relative to the housing, between a tamper switch engaged position and a tamper switch released position, the second direction being different than the first direction, wherein the first direction comprises a rotational direction about a longitudinal axis of the tamper actuator, and wherein the second direction comprises a translational direction along the longitudinal axis of the tamper actuator; and mounting the housing at a mounting surface.

17. The method of claim 16, wherein the housing comprises a first locking feature, wherein the tamper actuator comprises a second locking feature that is complementary to the first locking feature, and wherein moving the tamper actuator in the first direction to the tamper disabled position comprises engaging the second locking feature with the first locking feature to fix the tamper actuator in place at the housing.

18. The method of claim 17, wherein the second locking feature engages the first locking feature when the tamper actuator is at a first rotational position relative to the housing, and wherein the second locking feature is disengaged from the first locking feature when the tamper actuator is at a second rotational position relative to the housing, the second rotational position being different than the first rotational position.

19. The method of claim 16, wherein, when the tamper actuator is in the tamper enabled position, the tamper switch is actuatable by either removing the housing from a mounting surface at which the housing is mounted or opening a portion of the housing.

20. The method of claim 16, wherein the housing defines a guide sleeve, wherein the tamper actuator is received at the guide sleeve, wherein, when the tamper actuator is in the tamper enabled position, the tamper actuator is configured to move in the second direction, within the guide sleeve relative to the housing, between the tamper switch engaged position and the tamper switch released position.

* * * * *